US005226834A

United States Patent [19]

Kato et al.

[11] Patent Number: 5,226,834

[45] Date of Patent: Jul. 13, 1993

[54] INCOMPLETE FITTING PREVENTION CONNECTOR

[75] Inventors: Tetsuo Kato; Naoto Taguchi, both of Shizuoka, Japan

[73] Assignee: Yazaki Corporation, Tokyo, Japan

[21] Appl. No.: 774,891

[22] Filed: Oct. 11, 1991

[30] Foreign Application Priority Data

Oct. 12, 1990 [JP] Japan ..... 2-106562

[51] Int. Cl.[5] ..... H01R 3/00

[52] U.S. Cl. ..... 439/489; 439/358

[58] Field of Search ..... 439/488, 489, 350–358, 439/533, 345, 347

[56] References Cited

U.S. PATENT DOCUMENTS 4,867,699 9/1989 Oda et al. ..... 439/489
4,892,490 1/1990 Tsuchiya et al. ..... 439/489
4,993,967 2/1990 Matsumoto ..... 439/489

*Primary Examiner*—Gary F. Paumen
*Assistant Examiner*—Hien D. Vu
*Attorney, Agent, or Firm*—Sughrue, Mion, Zinn, Macpeak & Seas

[57] ABSTRACT

An incomplete fitting prevention connector wherein an insertion portion for a fixing bracket is provided at a female connector housing; a slide member is slidably provided on the female connector housing in abutment relation to a male connector housing inserted into the female connector housing; a retaining pawl is formed on the slider member so as to project to the insertion portion. Only when the male and female connectors are completely fitted together, the retaining portion of the slider member can be fitted relative to an engaging portion of the fixing bracket. Accordingly, the incomplete fitting between the male and female connector housing can be prevented.

4 Claims, 6 Drawing Sheets

INCOMPLETE FITTING PREVENTION CONNECTOR

BACKGROUND OF THE INVENTION

This invention relates to an incomplete fitting prevention connector in which the condition of fitting between male and female connectors can be confirmed by learning whether a fixing bracket is fitted relative to an insertion portion provided in one of connectors.

FIG. 7 is an exploded perspective view showing conventional connectors 56 and 57 adapted to be fixed together and adapted to be fixedly attached to an appropriate portion by a through bracket 52.

The through bracket 52 is made of a metal plate shaped into a generally L-shape, and has an engaging hole 53, and its proximal portion 54 is fixedly secured by welding to a panel 55 of a vehicle or the like. A female connector housing 58 has at one side portion thereof insertion rails 59 for the through bracket 52, and a retaining projection 60 for retaining the engaging hole 53. This female connector housing has at the other side portion an engaging guide 63 for receiving a flexible retaining arm 62 of a male connector housing 61, and an engaging window 65 for receiving a retaining projection 64 of the flexible retaining arm 62.

As shown in FIG. 8 showing an assembled condition taken along the line A—A of FIG. 7, the male connector 57 (i.e., the male connector housing 61 having terminals retained therein) is inserted into the female connector 56, and the insertion rails 59 of the female connector housing 58 are fitted on the through bracket 52. In this condition, the retaining projection 60 is fitted in the engaging hole 53 in the through bracket 52 to thereby prevent withdrawal thereof.

In the above conventional construction, however, even when the male and female connectors 57 and 56 are in an incomplete fitted condition, i.e. in a condition in which the retaining projection 64 is not completely engaged with the engaging window 65, mating terminals 66 and 67 are in contact with each other to provide electrical conduction. Therefore, there has been a risk that such an abnormal condition can not be checked at an inspection stage with the result that the product will be distributed to the market. If such a situation should be encountered, there would arise a disadvantage that the connector 57 is withdrawn from the connector 56, for example, by vibrations during the running of the vehicle.

SUMMARY OF THE INVENTION

With the foregoing in view, it is an object of this invention to provide a connector adapted to be fixed to an appropriate portion through a through bracket, in which an incomplete fitting between male and female connectors is positively prevented.

In order to achieve the above object, the present invention provides an incomplete fitting prevention connector adapted to be fixed to a through bracket, comprising: a pair of first and second connector housings to be fitted together; first means for locking the fitting between the connector housings; and second means for fixing the first connector onto the through bracket only when the fitting between the connector housings is locked by the first means.

According to a first aspect of the invention, there is provided an incomplete fitting prevention connector adapted to be fixed to a fixing bracket having an engagement portion through an insertion portion provided at one of male and female connector housings fixed to each other by retaining means, the connector comprising: a slide member slidably provided on the one of the connector housings and abuttable against the other of the connector housings, the slider having a retaining portion disposed in the insertion portion; and wherein when the male and female connectors are completely fixed together by the retaining means, the retaining portion can be fitted relative to the engaging portion of the fixing bracket.

According to a second aspect of the invention, there is provided an incomplete fitting prevention connector adapted to be fixed to a fixing bracket through an insertion portion provided at one of connector housings fitted together, the connector comprising: a member pivotably, movably mounted on the one of the connector housings, the member having a closure portion for an opening of the insertion portion and a withdrawal-prevention fitting portion for the other of the connector housings; and spring means for biasing the member so that the closure portion closes the opening of the insertion portion when the withdrawal-prevention fitting portion is not engaged with the other of the connector housings.

In the first aspect, the slide member mounted on the one connector housing is urged by the other connector housing to move, and when the two connectors are completely fitted together, the retaining portion of the slide member is fitted relative to the engaging portion of the fixing bracket to be fixed thereto. In the second aspect, in the condition of the incomplete fitting between the connector housings, the pivotably movable member mounted on the one connector housing is spring-biased to close the opening of the insertion portion, and in the completely-fitted condition, the pivotably movable member is pivotably moved to engage the withdrawal-prevention fitting portion with the other connector housing, so that the fixing bracket can be inserted into the opened insertion portion.

BRIEF DESCRIPTION OF THE DRAWINGS

FIG. 1A is an exploded perspective view before the fitting;

FIG. 1B is a perspective view after the fitting;

FIG. 4A is a vertical cross-sectional view;

FIG. 4B is a top plan view;

FIG. 5A is an exploded perspective view before the fitting;

FIG. 5B is a perspective view during the fitting;

FIG. 5C is a perspective view after the fitting;

DESCRIPTION OF THE PREFERRED EMBODIMENTS

Figure 1A:
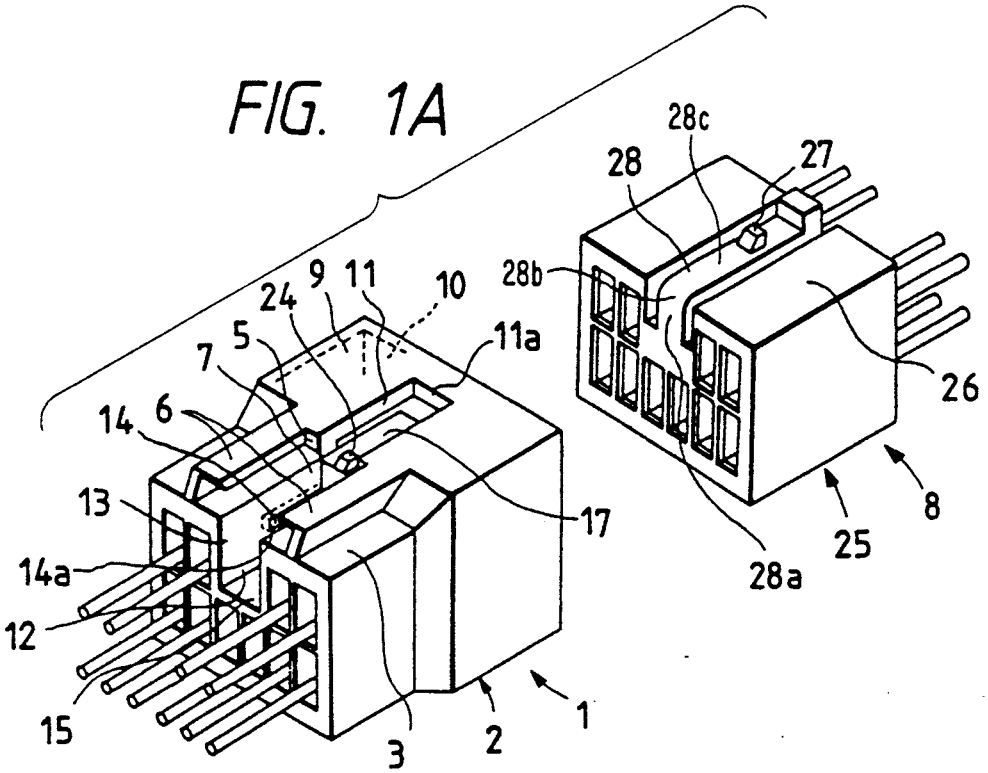
FIGS. 1A and 1B show a first embodiment of the present invention.
Figure 1B:
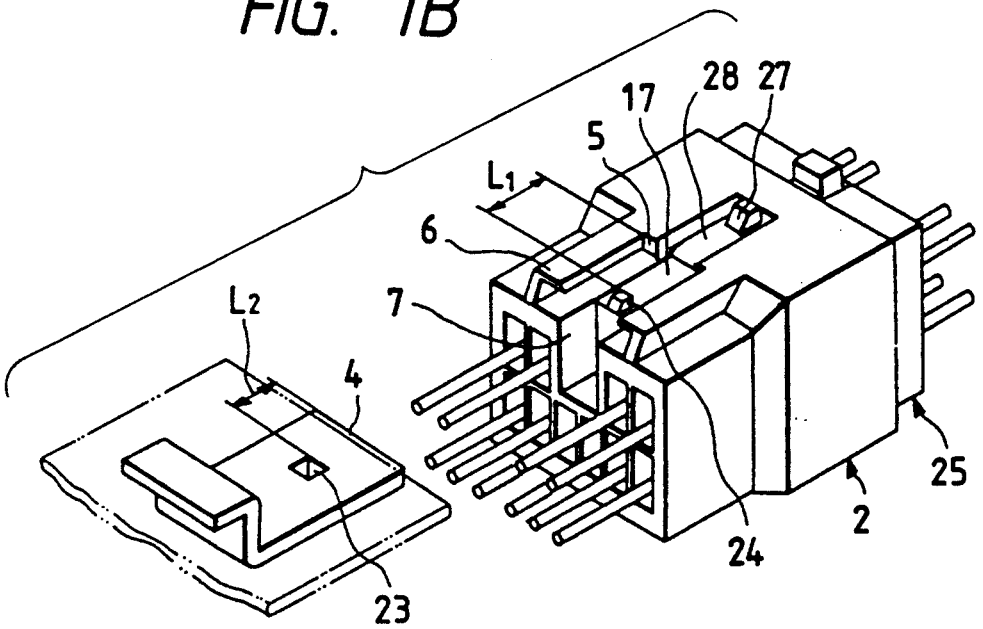
Figure 2:
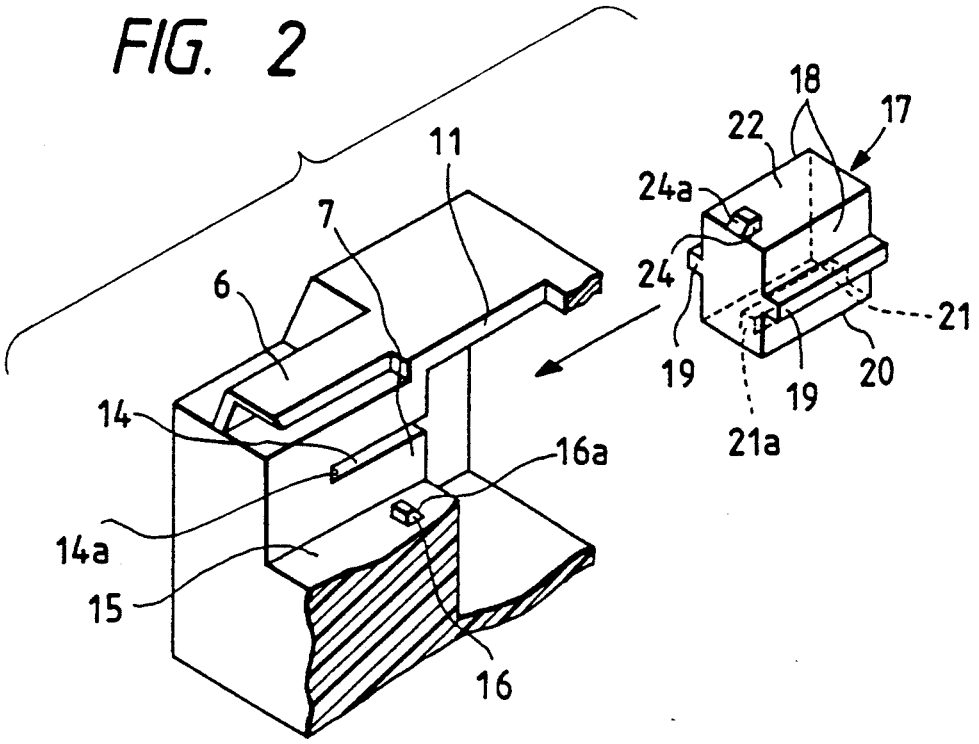
FIG. 2 is a partly-broken, exploded perspective view of an important portion of the above embodiment.

FIGS. 1A and 1B are perspective views of a first embodiment of an incomplete fitting prevention connector of the present invention, showing conditions before and after the fitting, respectively. FIG. 2 is a partly-broken, exploded perspective view of an important portion of this connector.

Referring to the drawings, a female connector 1 comprises a female connector housing 2 of a synthetic resin having terminals (not shown) retained therein. The female connector housing 2 has a pair of insertion guides 6 formed on an outer wall 3 of terminal retaining chambers, each of these insertion guides having a stopper end 5 for a fixing through bracket 4. A recessed groove portion 7 is formed in the central portion of the female connector housing below the insertion guides 6. An opening 11, communicated with a fitting chamber 10 and the recessed groove portion 7, (insertion portion) is formed through an outer wall 9 of the fitting chamber 10. The fitting chamber 10 is for inserting a male connector 8. A pair of rail grooves 14 each having a stopper end 14*a* are formed respectively in opposed side walls 12 of the recessed groove portion 7 so as to extend from the opening 11 side to a midway of the side walls 12 toward an electrical wire lead-out side 13, as shown in FIGS. 1 and 2. Formed on a bottom wall 15 is a stopper projection 16 (see FIG. 2) having an inclined surface 16*a* facing the opening 11 side. A slide member 17 of a synthetic resin is slidably fitted in the recessed groove portion 7 from the opening 11 side. As shown in FIG. 2, a pair of elongated engaging projections 19 for the rail grooves 14 are formed respectively on opposite side walls 18 of the slide member 17, and a rail groove 21 having a front stopper end 21*a* for the stopper projection 16 is formed in a bottom wall 20 of the slide member, and a retaining projection (retaining portion) 24 having a front inclined surface 24*a* for an engaging hole (engaging portion) 23 of the through bracket 4 is formed on an upper wall 22 of the slide member. The stopper ends 14*a* of the rail grooves 14 abut respectively against the engaging projections 19 of the slide member 17 to thereby prevent a forward withdrawal of the slide member 17, and the stopper projection 16 is abutted against the stopper end 21*a* of the rail groove 21 to thereby prevent a rearward withdrawal. A flexible retaining arm 28, having a retaining projection, or lock pawl, (retaining means) 27 for an end edge 11*a* of the opening 11, is provided at an outer wall 26 of a male connector housing 25 of the mating male connector 8. The retaining arm includes a fulcrum portion 28*b* integrally formed in the upper surface of the male connector housing and an arm portion 28*c* extending therefrom. As shown in FIG. 1B, as the male connector 8 is inserted into the female connector 1, the slide member 17 is urged by a proximal end surface 28*a* (FIG. 1) of the flexible retaining arm 28 of the male connector housing 25 to move in the recessed groove portion 7. The distance $L_1$ between the retaining projection 24 of the slide member 17 and the stopper end 5 of the insertion guide 6 in a completely-fitted condition of the connectors 1 and 8 is equal to the distance $L_2$ between the front end of the through bracket 4 and the engaging hole 23.

Figure 3A:
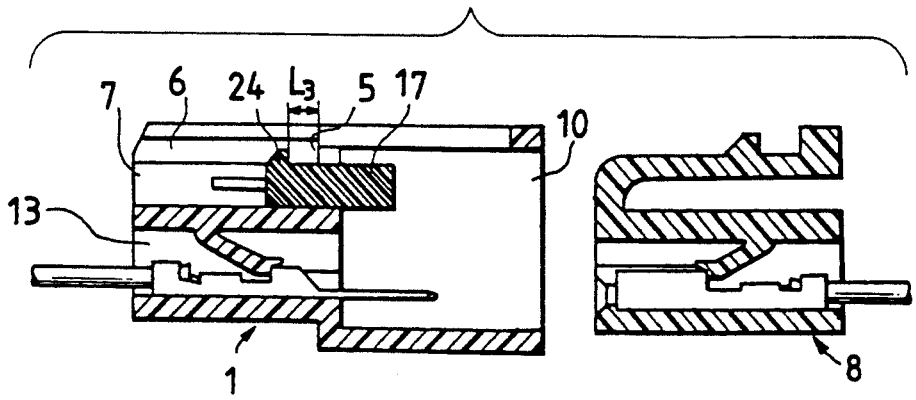
FIGS. 3A to 3B are views explanatory of the operation of the above embodiment.
Figure 3B:
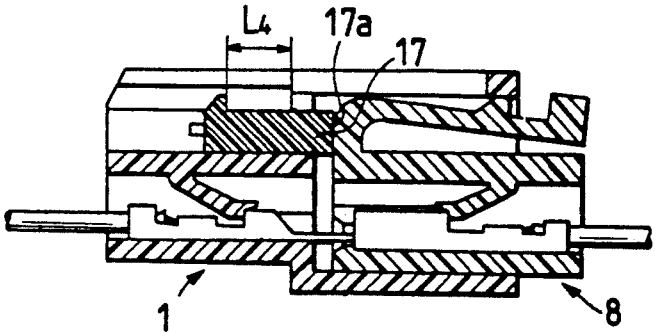
Figure 3C:
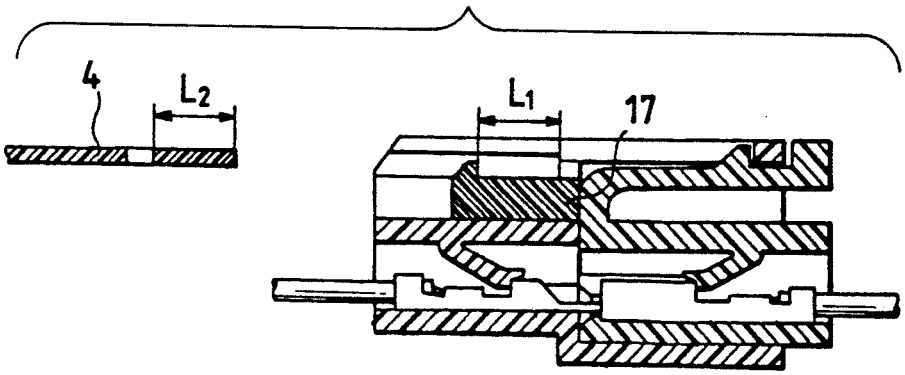

FIGS. 3A to 3C are views explaining the movement of the slide member 17 in response to the insertion of the connector 8 into the connector 1.

More specifically, FIG. 3A corresponds to FIG. 1A and shows the condition before the fitting between the connectors 1 and 8 in which the slide member 17 within the recessed groove 7 is disposed close to the fitting chamber 10. Even if the slide member 17 is disposed close to the electrical wire lead-out side 13, the retaining projection 24 is urged as the through bracket 4 is inserted into the insertion guides 6, so that the slide member is moved toward the fitting chamber 10. Since the distance $L_3$ between the stopper end 5 of the insertion guide 6 and the retaining projection 24 is shorter than the distance $L_2$ of the through bracket 4, the retaining projection 24 cannot be engaged with the engaging hole 23 of the through bracket 4. This condition is maintained even when the male connector 8 is incompletely inserted into the female connector 1, as shown in FIG. 3B, and the distance $L_4$ with respect to the slide member 17 pushed at its rear end 17*a* by the male connector 8 to advance is still shorter than the distance $L_2$ with respect to the through bracket 4. Therefore, the through bracket 4 cannot be retained, so that the condition of the incomplete fitting between the connectors 1 and 8 can be detected. FIG. 3C shows the completely-fitted condition in which the distance $L_1$ with respect to the slide member 17 is equal to the distance $L_2$ with respect to the through bracket 4, so that the retaining projection 24 can be engaged with the engaging hole 23 of the through bracket 4 and the through bracket 4, thus, can be retained.

Figure 4A:
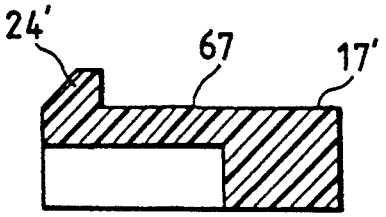
FIGS. 4A and 4B shows a modified slide member.
Figure 4B:
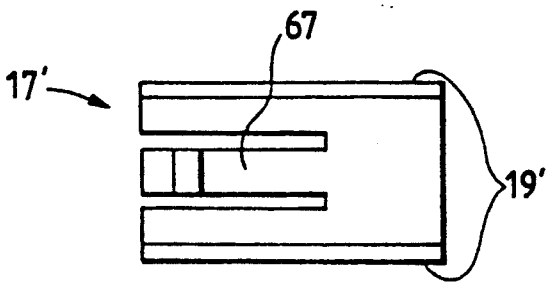

FIGS. 4A and 4B show a modified form of the above slide member 17, and FIG. 4A is a vertical cross-sectional view, and FIG. 4B is a plan view. This slide member 17' is characterized in that a flexible piece 67 having a retaining projection 24' is provided longitudinally at a central portion thereof, so that the engagement thereof in the engaging hole 23 of the through bracket 4 can be effected with a small force. In the drawings, reference numeral 19' denotes an elongated engaging projection for the rail groove 14.

In the constructions of FIGS. 1 to 4, a spring (not shown) of a weak force may be provided in the recessed groove portion 7 of the female connector housing 2 in abutting relation to the front end of the slide member 17, 17' to normally urge the slide member 17, 17' toward the fitting chamber 10.

Figure 5A:
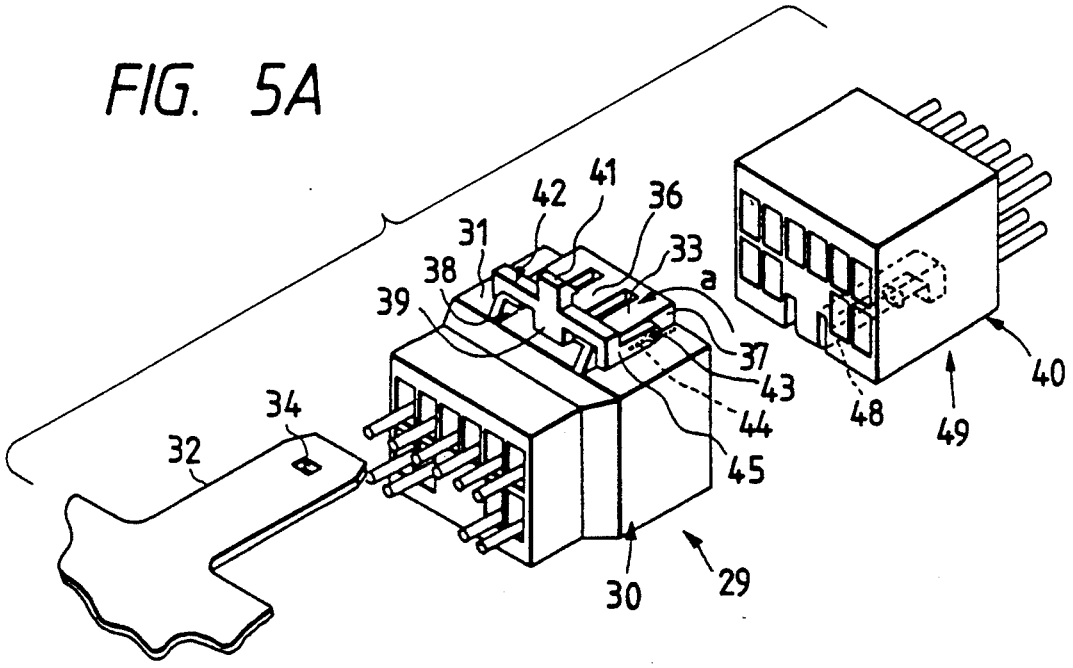
FIGS. 5A to 5C show a second embodiment of the invention.
Figure 5B:
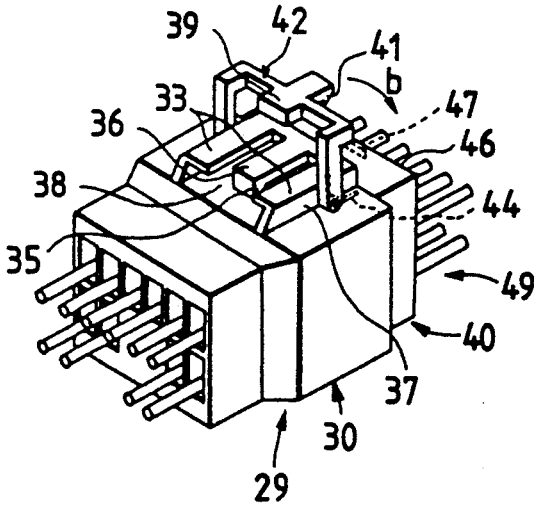
Figure 5C:
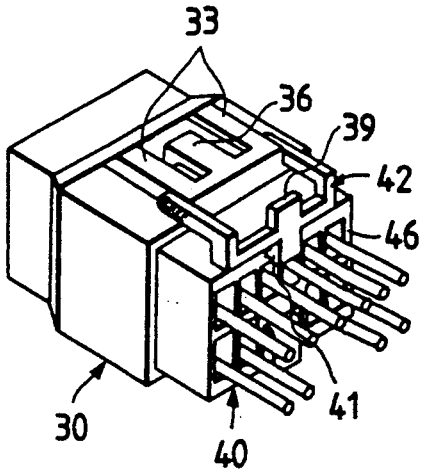

FIGS. 5A to 5C are perspective views showing the order of assembling of a second embodiment of an incomplete fitting prevention connector Of the present invention.

In these Figures, reference numeral 29 denotes a female connector, and a pair of insertion rails 33 for a fixing through bracket 32 are formed on an outer wall 31 of a female connector housing 30 of a synthetic resin. A flexible arm 36, having a retained pawl 35 for an engaging hole 34 in the through bracket 32, is formed between the insertion rails 33 in parallel relation thereto. A pivotably movable member 42 is pivotably, movably mounted on side walls 37 of the insertion rails, and this member 42 has at its front end a closing projection 39 for an opening 38 of the insertion rails 33 and also has at its rear end a withdrawal-prevention fitting pawl 41 for a mating male connector housing 40. A wound spring 44 is wounded around each rotary shaft 43 of the member 42, and one end of this spring is engaged with a pillar portion 45 of the member 42 whereas the other end thereof is engaged with the outer wall 31, so that in a free condition, the wound spring 44 urges the member 42 in a direction a to cause the closing projection 39 to close the opening 38. A retaining groove 47 (FIG. 5B) for the withdrawal-prevention fitting pawl 41 of the pivotable member 42 is formed in a rear end surface 46 of the male connector housing 40. As in the above embodiment, a flexible retaining arm 48 is provided on the male connector housing 40.

In a condition in which a male connector 49 is fitted in the female connector 29 (FIG. 5B), the pivotable member 42 is pivotably moved in a direction b against the bias of the springs 44 so as to engage the withdrawal-prevention fitting pawl 41 in the retaining groove 47 in the male connector housing 40 (FIG. 5C). Finally, the insertion rails 33 are fitted on the through bracket 32.

Figure 6A:
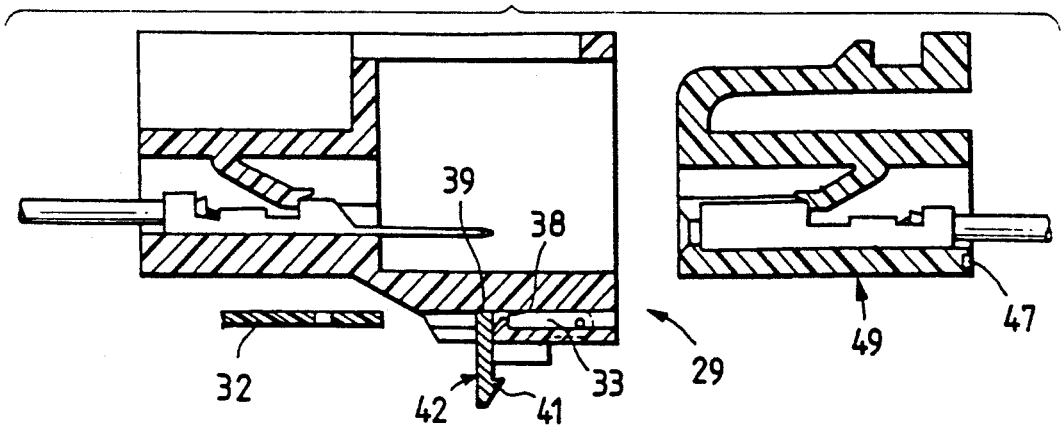
FIGS. 6A to 6C are views explanatory of the operation of the second embodiment.
Figure 6B:
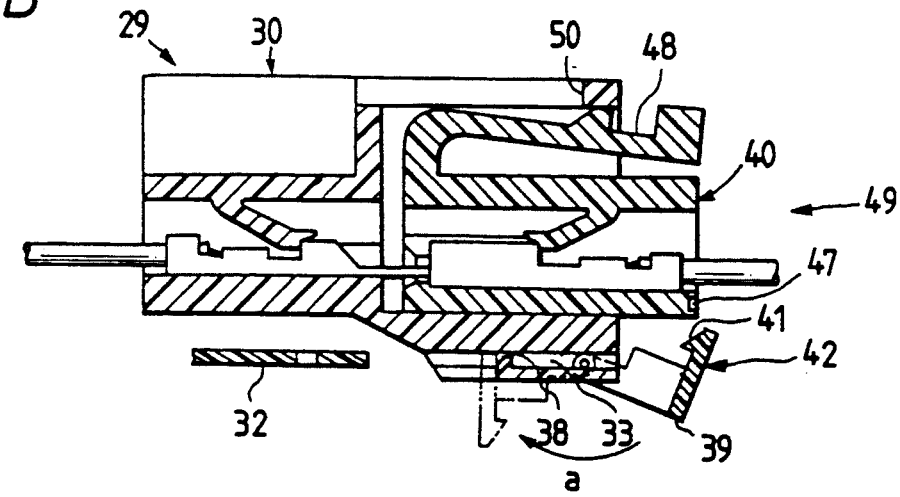
Figure 6C:
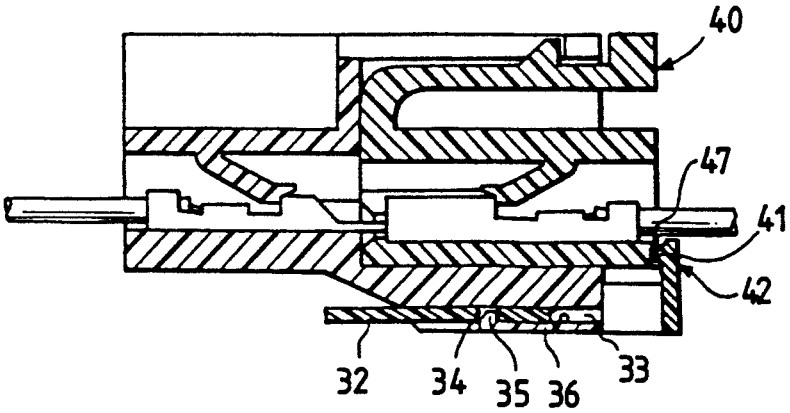
Figure 7:
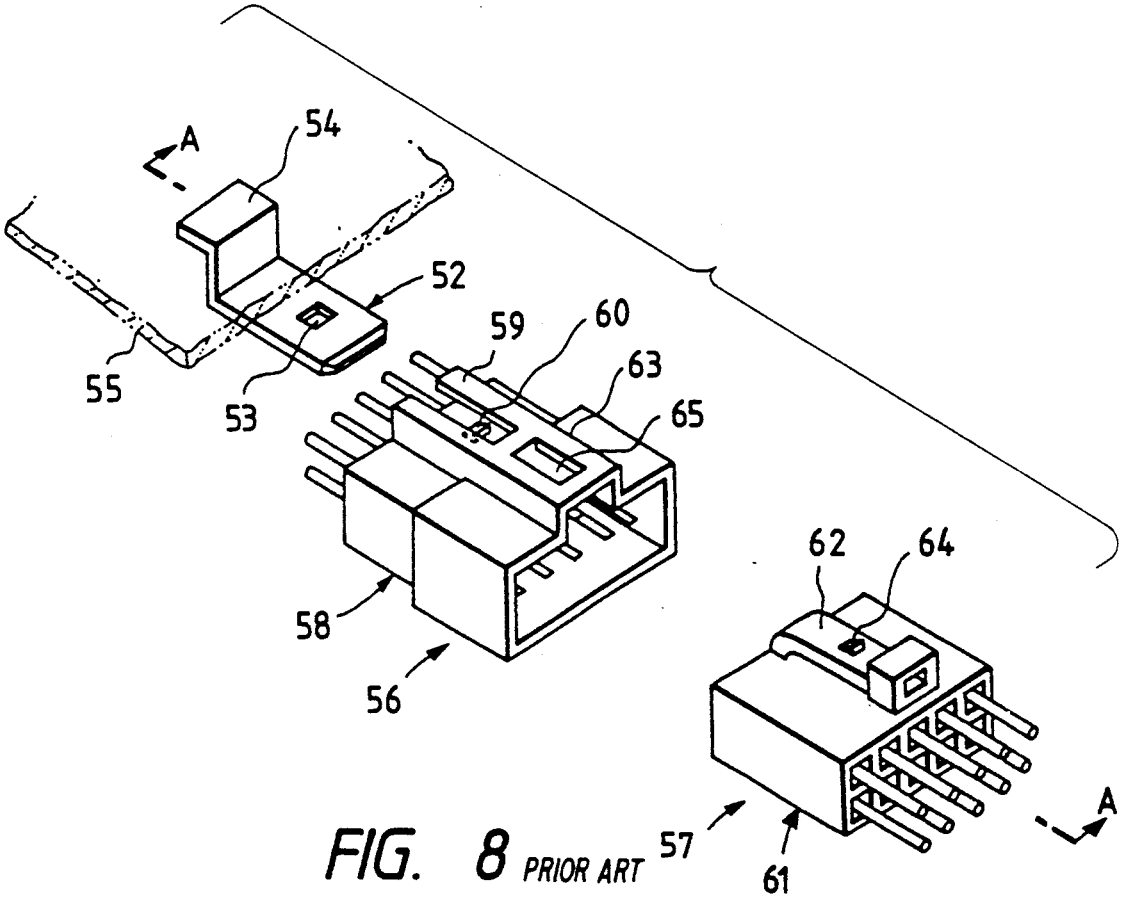
FIG. 7 PRIOR ART
FIG. 7 is an exploded perspective view of a conventional example.
Figure 8:
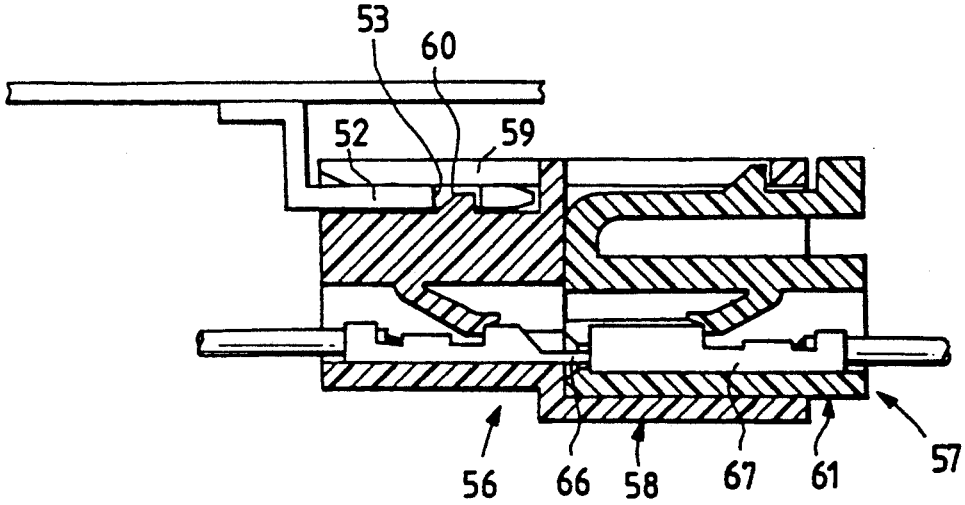
FIG. 8 PRIOR ART
FIG. 8 is a cross-sectional view of the conventional example during the fitting, taken along the line A—A of FIG. 7.

FIGS. 6A to 6C are views showing the order of assembling of this construction.

More specifically, FIG. 6A shows the condition before the fitting between the connectors 29 and 49, corresponding to that of FIG. 5A, and the pivotable member 42 is spring-biased, so that the closing projection 39 is disposed at the opening 38 of the insertion rail 33. Therefore, in this condition, the through bracket 32 can not be attached. FIG. 6B shows the condition of the incomplete fitting between the connectors 29 and 49, and the flexible retaining arm 48 is not yet engaged in a retaining hole 50 in the female connector housing 30. In this condition, even if the pivotable member 42 is pivotably moved, the withdrawal-prevention fitting pawl 41 can not be engaged in the retaining groove 47 in the male connector housing 40, and the pivotable member 42 is returned in the direction a under the spring bias, so that the closing projection 39 is positioned at the opening 38 of the insertion rails 33. Therefore, the through bracket 32 can not be attached, and the condition of the incomplete fitting between the connectors can be detected. FIG. 6C shows the completely-fitted condition, and the withdrawal-prevention fitting pawl 41 of the pivotable member 42 is engaged in the retaining groove 47 in the male connector housing 40, so that the angularly-movable member is fixed, and the through bracket 32 is inserted from the opening 38 of the insertion rails 33, so that the retaining projection 35 of the flexible arm 36 is engaged in the engaging hole 34 of the through bracket.

As described above, in the present invention, the incomplete fitting between the connectors can be detected or prevented, and therefore defective products will not be distributed to the market, and the reliability in the electrical connection in a vehicle or the like can be enhanced.

What is claimed is:

1. An incomplete fitting prevention connector adapted to be fixed to a fixing bracket having an engaging portion, said fixing bracket being received in an insertion portion provided on one of male and female connector housings, adapted to have electrical contacts and fixed to each other by retaining means, said connector comprising:

a slider slidably provided in said one connector housing at a position at which the other connector housing can contact said slider such that said slider is moved by the other connector housing from a non-engaged position to a completely engaged position when said other connector housing is fixed to said one connector housing by said retaining means, said slider having a retaining portion disposed in said insertion portion when in said completely engaged position; wherein in said completely engaged position said retaining portion is engaged with said engaging portion of said fixing bracket.

2. An incomplete fitting prevention connector adapted to be fixed to a through bracket, comprising:

a pair of first and second connector housings adapted to be fitted together;

first means for locking said connector housings together; and second means for securing said first connector onto said through bracket only when said connector housings are locked together by said first means, wherein said second means includes a guide provided on said first connector housing for guiding said through bracket to a first position, a slider slidably provided in said first connector housing, said a slider being guided to a second position when said connector housings are fully secured together by said first means, and engagement means for engaging said through bracket in said first position with said slider in said second position.

3. The connector according to claim 2, wherein said first and second connector housings are female and male connector housings, respectively, and said first means included a retaining arm having a fulcrum portion integrally formed on an upper surface of said male connector housing an arm portion extending from said fulcrum substantially parallel to the upper surface of said male connector housing, and a lock pawl projected upwardly from said arm portion, and a retaining hole formed on said female connector housing for engagement with said lock pawl when said male connector housing is inserted into said female connector housing in place.

4. The connector according to claim 2, wherein said engagement means includes an engaging hole formed in said through bracket and an engaging projection formed on said slider and engaged with said engaging hole when said through bracket and said slider are in said first and second position respectively.

* * * * *